US007270515B2

(12) United States Patent
Liang

(10) Patent No.: US 7,270,515 B2
(45) Date of Patent: Sep. 18, 2007

(54) TURBINE AIRFOIL TRAILING EDGE COOLING SYSTEM WITH SEGMENTED IMPINGEMENT RIBS

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 100 days.

(21) Appl. No.: 11/138,173

(22) Filed: May 26, 2005

(65) Prior Publication Data

US 2006/0269408 A1 Nov. 30, 2006

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 4,278,400 A 7/1981 Yamarik et al.
5,246,340 A 9/1993 Winstanley et al.
5,288,207 A 2/1994 Linask
5,403,159 A * 4/1995 Green et al. ..... 416/97 R
5,536,143 A 7/1996 Jacala et al.
5,599,166 A * 2/1997 Deptowicz et al. ..... 416/97 R
5,609,466 A 3/1997 North et al.
5,700,131 A 12/1997 Hall et al.
5,931,638 A 8/1999 Krause et al.
5,975,851 A 11/1999 Liang
2004/0120803 A1 6/2004 Lucas et al.
2004/0136824 A1 7/2004 Boyer
2004/0170498 A1 9/2004 Peterman et al.
2005/0008487 A1 1/2005 Lee et al.
2005/0031451 A1 2/2005 Cunha
2006/0133935 A1* 6/2006 Papple ..... 416/97 R

FOREIGN PATENT DOCUMENTS

EP 1327747 A2 7/2003
WO WO95/14848 6/1995

* cited by examiner

*Primary Examiner*—Richard A. Edgar

(57) ABSTRACT

A cooling system for a turbine airfoil of a turbine engine having multiple segmented ribs aligned together spanwise within a trailing edge cooling channel. The segmented ribs may be positioned proximate to a trailing edge of the turbine airfoil to facilitate increased heat removal with less cooling fluid flow, thereby resulting in increased cooling system efficiency, and to increase the structural integrity of the trailing edge of the airfoil. The segmented ribs may include crossover orifices that provide structural integrity to ceramic cores used during manufacturing to prevent cracking and other damage.

16 Claims, 4 Drawing Sheets

TURBINE AIRFOIL TRAILING EDGE COOLING SYSTEM WITH SEGMENTED IMPINGEMENT RIBS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots.

Localized hot spots, depending on their location, can reduce the useful life of a turbine blade and can damage a turbine blade to an extent necessitating replacement of the blade. Often, conventional turbine blades develop hot spots in the trailing edge of the blade. While the trailing edge of the turbine blade is not exposed to as harsh of conditions as a leading edge of the blade, the trailing edge requires cooling nonetheless. Thus, a need exists for a cooling system capable of providing sufficient cooling to composite airfoils while also providing sufficient structural support to the airfoil as well.

SUMMARY OF THE INVENTION

This invention relates to a turbine airfoil cooling system including a trailing edge cooling channel with at least one segmented rib having a plurality of impingement orifices. The segmented rib increases the efficiency of the cooling system in the airfoil and increases the strength of the airfoil in the trailing edge region. The trailing edge cooling channel may be configured such that during manufacturing of the channel, the likelihood of damage to a ceramic core used to create the internal cooling channels is reduced. The trailing edge cooling channel may be configured such that a ceramic core used to produce the airfoil has greater structural strength, thereby reducing the risk of cracking and other damage to the ceramic core during formation of the airfoil.

The turbine airfoil may be formed from a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil. The turbine airfoil may include at least one trailing edge cooling channel extending from the root to the tip section of the elongated airfoil. The trailing edge cooling channel may include at least one first segmented spanwise rib positioned in the at least one trailing edge cooling channel, that extends generally from the root to the tip section of the elongated airfoil. The first segmented spanwise rib may include a plurality of impingement orifices.

The trailing edge cooling channel may also include at least one second segmented spanwise rib positioned in the at least one trailing edge cooling channel that extends generally from the root to the tip section of the elongated airfoil. The trailing edge cooling channel may be positioned between the first segmented spanwise rib and the trailing edge of the generally elongated airfoil and include a plurality of impingement orifices. In another embodiment, the trailing edge cooling channel may include at least one third segmented spanwise rib extending generally from the root to the tip section of the elongated airfoil and positioned in the at least one trailing edge cooling channel between the second segmented spanwise rib and the trailing edge of the generally elongated airfoil. The third segmented spanwise rib may also include a plurality of impingement orifices.

The plurality of impingement orifices may increase turbulence in the trailing edge cooling channel, thereby increasing the effectiveness of the cooling channel by increasing the convection rate in the channel. In at least one embodiment, the impingement orifices in the segmented ribs may be offset spanwise relative to the impingement orifices in upstream segmented ribs.

In another embodiment, the segmented cooling channels may include crossover orifices that provide a cooling fluid pathway through the segmented cooling channels and structural integrity to a ceramic core used to produce the cooling channel. In at least one embodiment, crossover orifices may be positioned between ends of the segmented cooling channels and the tip section and between an opposite end of the segmented cooling channels and the root. Such a configuration enables a rectangular support structure to be formed within a ceramic core used to create the airfoil with an internal cooling channel. The rectangular support structure greatly enhances the structural integrity of the ceramic core in the trailing edge region, thereby reducing the likelihood of damage to the ceramic core during the manufacturing process.

The crossover orifices in the adjacent segmented ribs may be aligned spanwise. Alternatively, the crossover orifices may be offset spanwise in the adjacent segmented ribs. In yet another embodiment, the segmented ribs may not include cross-over orifices. The crossover orifices may be distinguishable from the impingement orifices in that the crossover orifices may have a cross-sectional area that is greater than a cross-sectional area for the impingement orifices. In at least one embodiment, the crossover orifices may have a cross-sectional diameter generally equal to a distance between inner surfaces of the suction and pressure sides.

During use, cooling fluids, which may be, but are not limited to, air, flow into the cooling system from the root of the airfoil. At least a portion of the cooling fluids flow into the trailing edge cooling channel. The cooling fluids flow spanwise through the impingement orifices in the segmented ribs. In embodiments in which the impingement orifices and the crossover orifices are offset, cooling fluids pass through a rib and impinge on a downstream rib. The cooling fluids increase in temperature, thereby reducing the temperature of the airfoil. The cooling fluids are discharged through either orifices or through trailing edge orifices.

An advantage of this invention is that the segmented ribs form a rectangular grid structure that increase the ceramic core stiffness, thereby minimizing the likelihood of ceramic core breakage during manufacturing and improving the manufacture cast yields.

Another advantage of this invention is that the segmented ribs increase the cross-sectional area of the ceramic core at the ribs, which reduces the risk of core breakage due to shear forces developed from differential shrink rates of the ceramic core, external shell and molten metal.

Yet another advantage of this invention is that the increased cross-sectional area of the core of the airfoil increases the moment of inertia, which in turn improves the resistance to local edge bending at the trailing edge and total bending at the trailing edge.

Another advantage of this invention is that the invention improves ceramic core breakage modes, such as shear, local edge bending, and overall bending at the trailing edge, thereby creating a stiffer trailing edge for a ceramic core during manufacturing with reduced risk of breakage due to overall trailing edge bending and improved manufacturability.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
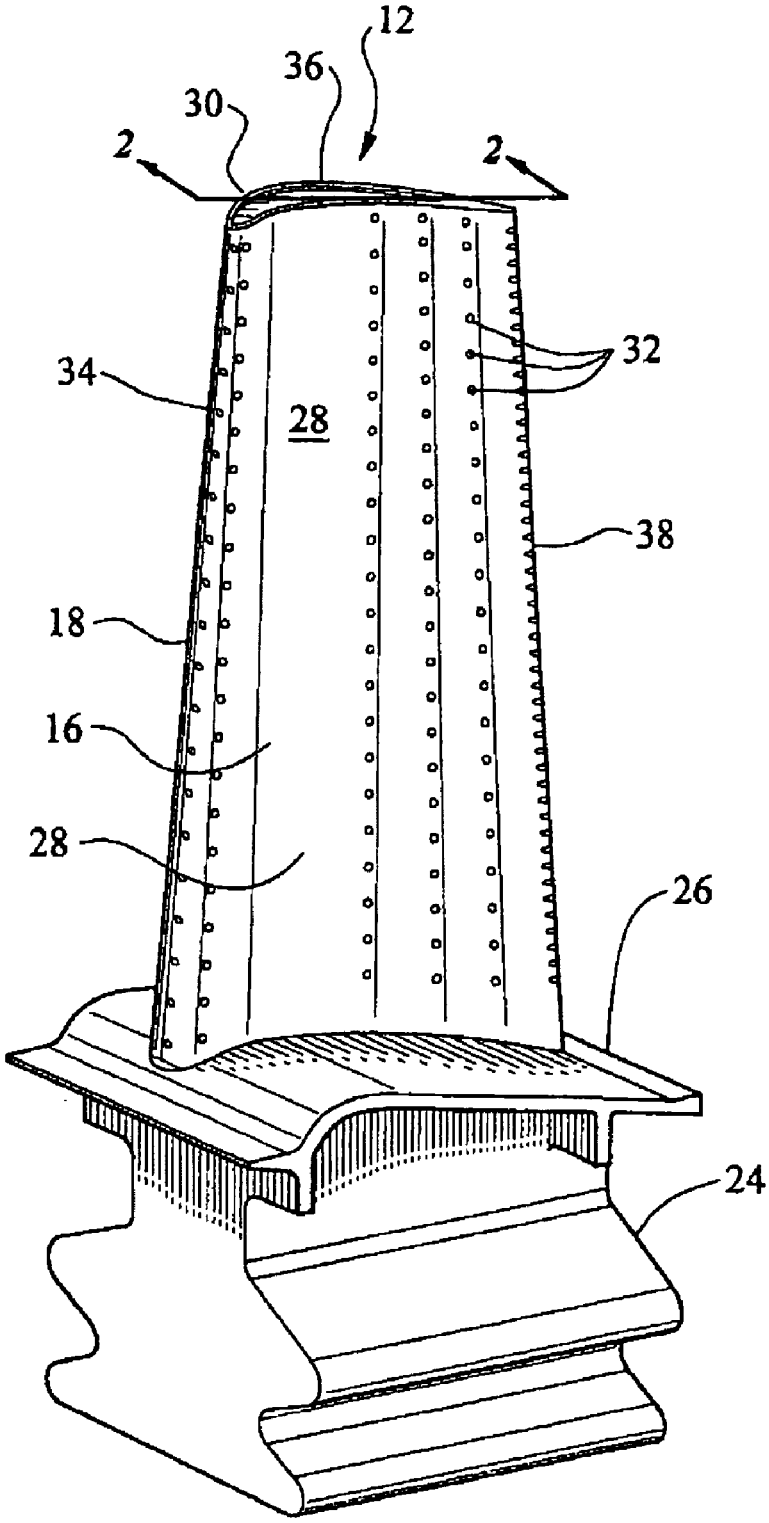
FIG. 1 is a perspective view of a turbine airfoil having features according to the instant invention.

As shown in FIGS. 1-7, this invention is directed to a turbine airfoil cooling system 10 for turbine airfoil 12 used in turbine engines. In particular, the turbine airfoil cooling system 10 is directed to a cooling system 10 located in a cavity 14, as shown in FIGS. 2-7, positioned between two or more walls 18 forming a housing 16 of the turbine airfoil 12. The cooling system 10 may include a trailing edge cooling channel 20 adapted to receive cooling fluids to reduce the temperature of the turbine airfoil 12 thereby reducing the required cooling fluid flow to achieve adequate cooling and increasing the effectiveness of the cooling system 10. The trailing edge cooling channel 20 may be configured such that during manufacturing of the channel 20, the likelihood of damage to a ceramic core is reduced. The trailing edge cooling channel 20 may be configured such that a ceramic core 68, which forms the cavities 14, used to produce the airfoil 12 has greater structural strength, thereby reducing the risk of cracking and other damage during formation of the airfoil 12.

Figure 2:
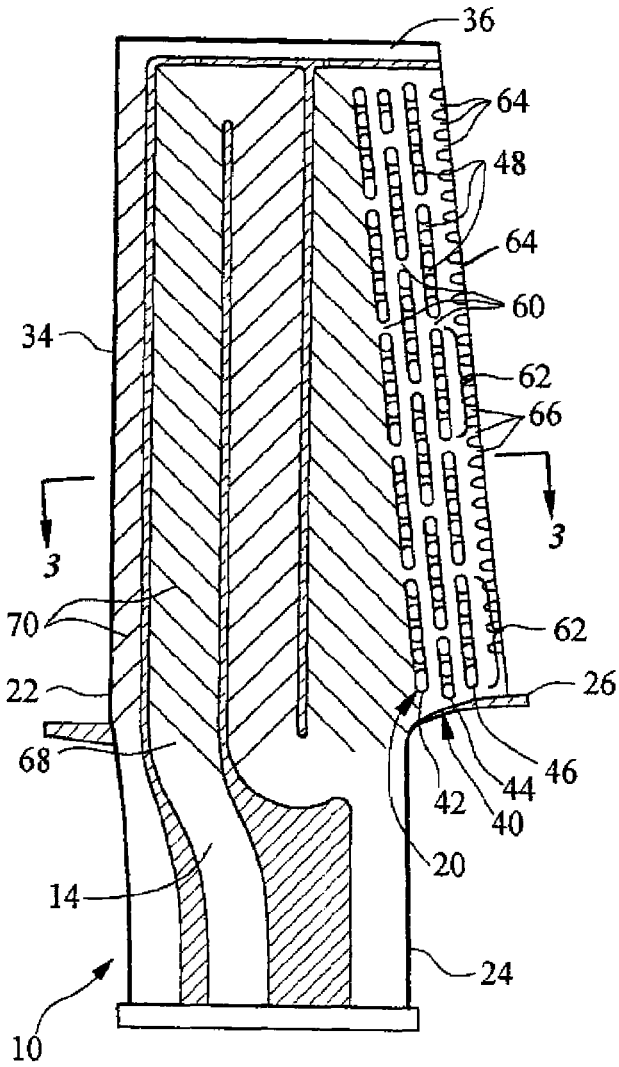
FIG. 2 is cross-sectional view, referred to as a filleted view, of the turbine airfoil shown in FIG. 1 taken along line 2-2.
Figure 3:
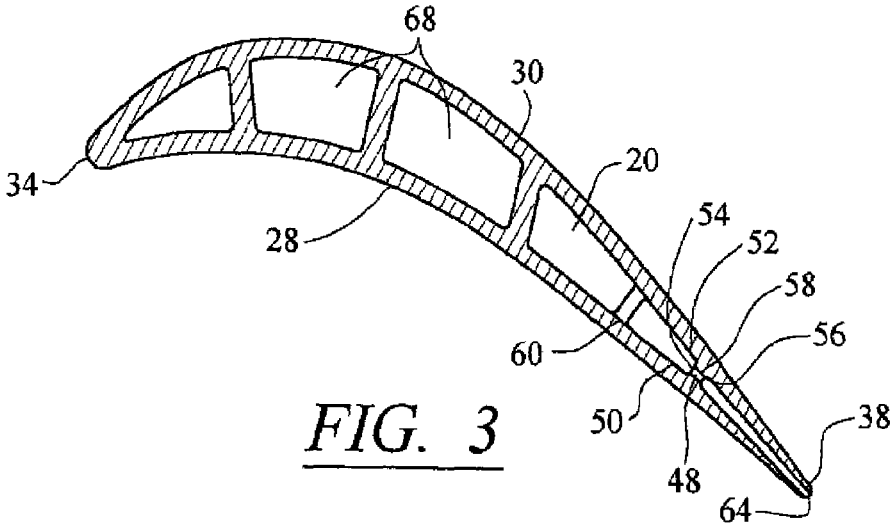
FIG. 3 is cross-sectional view of the turbine airfoil shown in FIG. 2 taken from the line 3-3 in FIG. 2.
Figure 4:
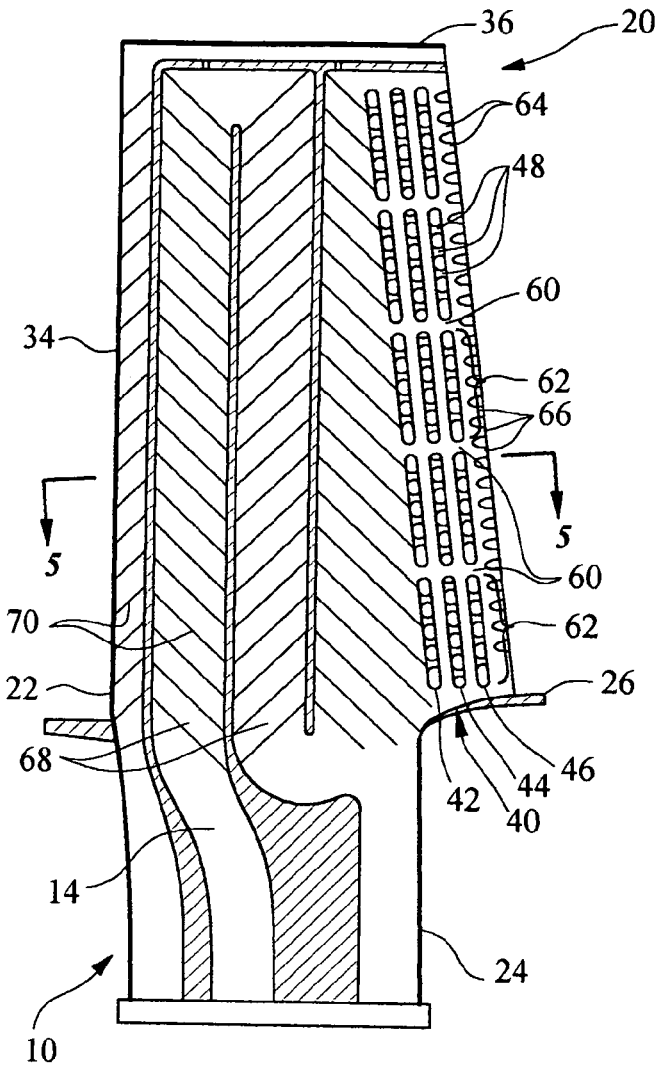
FIG. 4 is a cross-sectional view of an alternative embodiment of the turbine airfoil shown in FIG. 1 taken from the same perspective as line 2-2.
Figure 5:
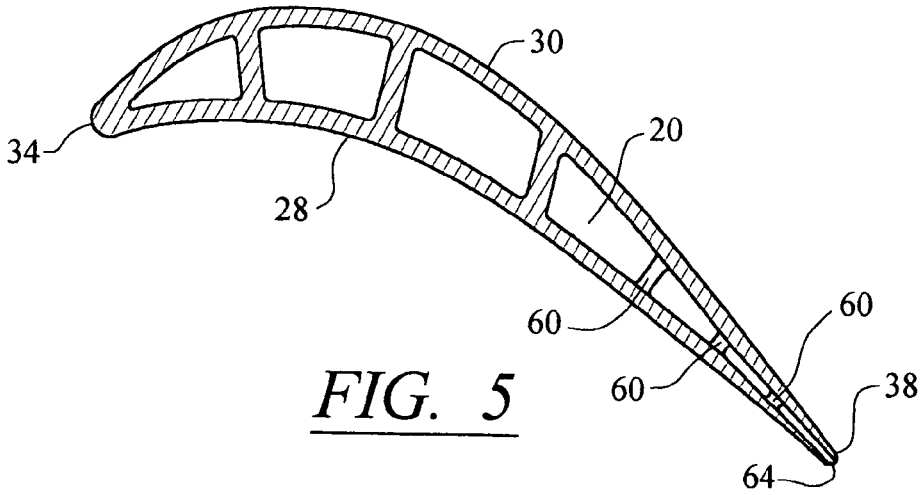
FIG. 5 is cross-sectional view of the turbine airfoil shown in FIG. 4 taken from the line 5-5.
Figure 6:
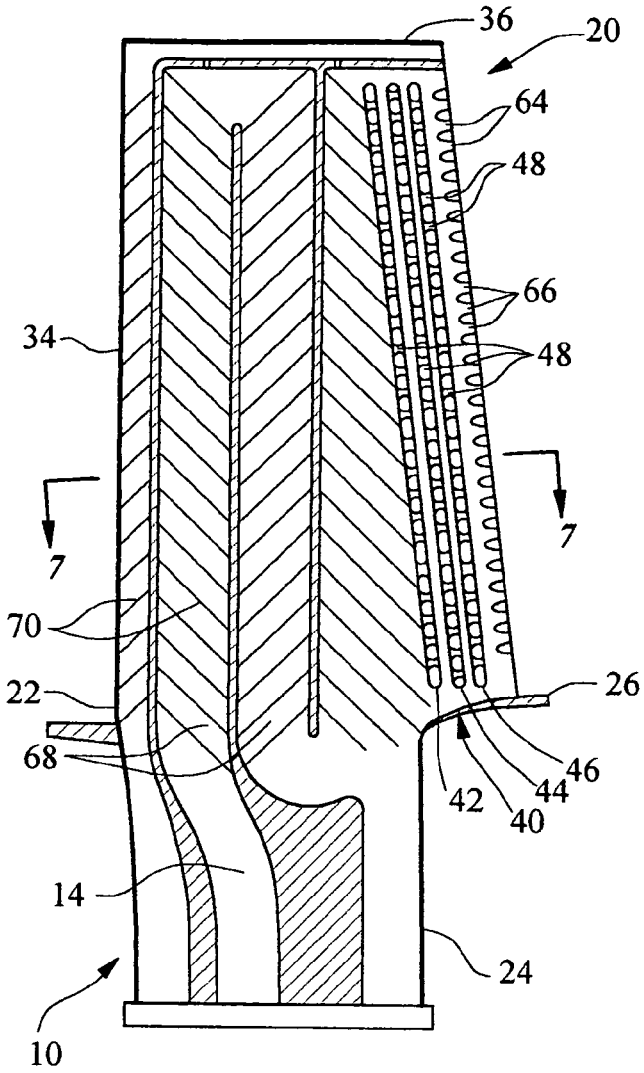
FIG. 6 is a cross-sectional view of an alternative embodiment of the turbine airfoil shown in FIG. 1 taken from the same perspective as line 2-2.
Figure 7:
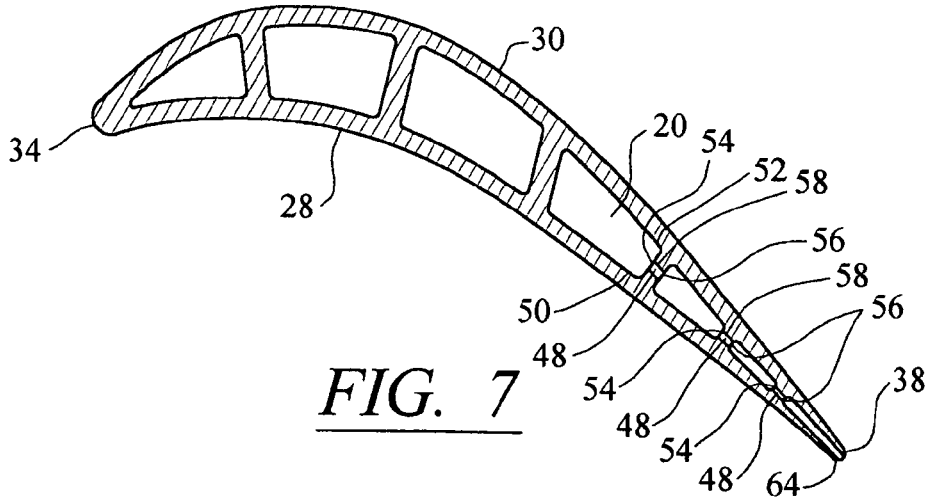
FIG. 7 is cross-sectional view of the turbine airfoil shown in FIG. 6 taken from the line 7-7.

The turbine airfoil 12 may be formed from a generally elongated airfoil 22 coupled to a root 24 at a platform 26. The turbine airfoil 12 may be formed from conventional metals or other acceptable materials. The generally elongated airfoil 22 may extend from the root 24 to a tip section 36 and include a leading edge 34 and trailing edge 38. Airfoil 22 may have an outer wall 18 adapted for use, for example, in a first stage of an axial flow turbine engine. Outer wall 18 may form a generally concave shaped portion forming pressure side 28 and may form a generally convex shaped portion forming suction side 30. The cavity 14, as shown in FIGS. 2-7, may be positioned in inner aspects of the airfoil 22 for directing one or more gases, which may include air received from a compressor (not shown), through the airfoil 22 and out one or more orifices 32 in the airfoil 22 to reduce the temperature of the airfoil 22 and provide film cooling to the outer wall 18. The cavity 14 may include trip strips 70, as shown in FIGS. 2, 4, and 6. The trip strips 70 may be positioned nonparallel to the direction of flow of the cooling fluids through the cavity 14. As shown in FIG. 1, the orifices 32 may be positioned in a leading edge 34, a tip section 36, or outer wall 18, or any combination thereof, and have various configurations. The cavity 14 may be arranged in various configurations and is not limited to a particular flow path.

The cooling system 10, as shown in FIGS. 2-7, may include a trailing edge cooling channel 20 for removing heat from the airfoil 22 proximate to the trailing edge 38. The trailing edge cooling channel 20 may include one or more segmented ribs 40 extending generally spanwise within the cooling channel 20. In at least one embodiment, the segmented ribs 40 extend generally from the root 24 to the tip section 36. However, in an alternative embodiment, the segmented ribs 40 may be formed in other lengths. As shown in FIGS. 2, 4, and 6, the trailing edge cooling channel may be formed from a first segmented rib 42, a second segmented rib 44, and a third segmented rib 46. The segmented ribs 42, 44, 46 may extend generally spanwise and parallel to each other. The third segmented rib 46 may be positioned between the second segmented rib 44 and the trailing edge 38 of the airfoil 22, and the second segmented rib 44 may be positioned between the first segmented rib 42 and the trailing edge 38. The segmented ribs 42, 44, 46 may extend from the pressure side 28 to the suction side 30. In alternative embodiments, the trailing edge cooling channel may include greater than or fewer than three segmented ribs.

The segmented ribs 42, 44, 46 may include one or more impingement orifices 48. The impingement orifices 48 may be sized, such as those shown in FIGS. 3 and 7, to have a diameter that is smaller than a distance between an inner surface 50 of the pressure side 28 and an inner surface 52 of the suction side 30. The impingement orifices 48 may also have a substantially hourglass cross-sectional shape in which an inlet 54 tapers to a smaller diameter center region 58. Similarly, an outlet 56 may taper to the center region 58 as well. Alternatively, the impingement orifices 48 may have other appropriate sizes. The impingement orifices 48 may be offset relative to each other. For instance, as shown in FIG. 2, 4, 6, the impingement orifices 48 in the second segmented rib 44 may be offset relative to the impingement orifices 48 in the first segmented rib 42. Similarly, the impingement orifices 48 in the second segmented rib 44 may be offset relative to the impingement orifices 48 in the third segmented rib 42. Offsetting the impingement orifices 48 creates convection rate increasing turbulence in the trailing edge cooling channel 20 by causing cooling fluids to impinge on downstream segmented ribs 40.

The segmented ribs 42, 44, 46 may include one or more crossover orifices 60 that break the ribs 42, 44, 46 into a plurality of parallel, aligned segments 62. The crossover orifices 60 provide structural integrity to a ceramic core 68 used to manufacture the airfoil 12. The crossover orifices 60 may be larger in cross-sectional area than the impingement orifices 48. In at least one embodiment, as shown in the embodiments in FIGS. 3, 5, the crossover orifices 60 may extend from the inner surface 50 on the pressure side 28 to the inner surface 52 on the suction side 30. The crossover orifices 60 may have other sizes as well.

The segmented ribs 42, 44, 46 may include one or more crossover orifices 60 along their lengths. In at least one embodiment, the crossover orifices 60 may be positioned between the ribs 42, 44, 46 and the tip section 36 and between the ribs 42, 44, 46 and the root 24. Such a configuration forms a generally rectangular support structure in a ceramic core 68 used to form the trailing edge cooling channel 20. The rectangle extends along the trailing edge 38 of the airfoil 12, along the tip section 36 and the root 24, and the portion of the ceramic core 68 used to form the cavity 14 proximate to the first segmented rib 42. The rectangular support structure greatly improves the reliability of the ceramic core 68 while reducing the risk of cracking and damage to the ceramic core 68 before the ceramic core 68 is removed later in the manufacturing process through conventional leaching processes.

The crossover orifices 60 may be aligned spanwise, as shown in FIG. 4. Alternatively, the crossover orifices 60 may be offset from each other. For example, as shown in FIG. 2, the crossover orifices 60 in the third segmented rib 46 may be offset spanwise from the crossover orifices 60 in the second segmented rib 44. Similarly, the crossover orifices 60 in the second segmented rib 44 may be offset spanwise from the crossover orifices 60 in the first segmented rib 42. In yet another embodiment, the segmented ribs 42, 44, and 46 may not include any crossover orifices 60, but include only impingement orifices 48.

The trailing edge cooling channel 20 may also include a plurality of support ribs 66 positioned in close proximity to the trailing edge 38, as shown in FIGS. 2, 4, and 6. The support ribs 66 may have any configuration appropriate for increasing the strength of the airfoil 22 to reduce local trailing edge bending and overall trailing edge bending. In the embodiments shown in FIGS. 2, 4, and 6, the support ribs 66 may have a generally rounded upstream corner and conclude at the trailing edge 38.

During operation, cooling fluids, which may be, but are not limited to, air, flow into the cooling system 10 from the root 24. At least a portion of the cooling fluids flow into the cavity 14 and into the trailing edge cooling channel 20. The cooling fluids flow spanwise through the impingement orifices 48 in the segmented ribs 42, 44, 46. In embodiments in which the impingement orifices 48 and the crossover orifices 60 are offset, cooling fluids pass through a rib 42, 44, 46 and impinge on a downstream rib 44, 46. The cooling fluids increase in temperature, thereby reducing the temperature of the airfoil 22. The cooling fluids are discharged through either orifices 32 or through trailing edge orifices 64.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil;

at least one trailing edge cooling channel extending from the root to the tip section of the elongated airfoil;

at least one first segmented spanwise rib positioned in the at least one trailing edge cooling channel, extending generally from the root to the tip section of the elongated airfoil, and including a plurality of impingement orifices;

at least one second segmented spanwise rib positioned in the at least one trailing edge cooling channel, extending generally from the root to the tip section of the elongated airfoil, positioned between the first segmented spanwise rib and the trailing edge of the generally elongated airfoil, and including a plurality of impingement orifices;

at least one crossover orifice positioned between an end of the at least one first segmented spanwise rib and the tip section of the airfoil and between another end of the at least one first segmented spanwise rib and the root;

at least one crossover orifice positioned between an end of the at least one second segmented spanwise rib and the tip section of the airfoil and between another end of the at least one second segmented spanwise rib and the root;

at least one crossover orifice in the at least one first segmented spanwise rib between the crossover orifices at each end at least one first segmented spanwise rib and extending generally from an inner surface of a suction side of the airfoil to an inner surface of a pressure side of the airfoil;

at least one crossover orifice in the at least one second segments spanwise rib between the crossover orifices at each end of the at least one second segmented spanwise rib and extending generally from the inner surface of the suction side of the airfoil to the inner surface of the pressure side of the airfoil; and wherein the crossover orifices each have a larger cross-sectional area than cross-sectional areas of the impingement orifices.

2. The turbine airfoil of claim 1, wherein the at least one crossover orifices in the first and second segmented spanwise ribs extend generally from an inner surface of a suction side of the airfoil to an inner surface of a pressure side of the airfoil.

3. The turbine airfoil of claim 1, wherein the at least one crossover orifice of the at least one first segmented spanwise rib is aligned spanwise with the at least one crossover orifice of the at least one second segmented spanwise rib.

4. The turbine airfoil of claim 1, wherein the plurality of impingement orifices in the at least one first segmented spanwise rib are offset spanwise with the plurality of impingement orifices in the at least one second segmented spanwise rib.

5. The turbine airfoil of claim 1, wherein the at least one crossover orifice of the at least one first segmented spanwise rib is offset spanwise from the at least one crossover orifice of the at least one second segmented spanwise rib.

6. The turbine airfoil of claim 5, wherein the plurality of impingement orifices in the at least one first segmented spanwise rib are offset spanwise with the plurality of impingement orifices in the at least one second segmented spanwise rib.

7. The turbine airfoil of claim 1, further comprising at least one third segmented spanwise rib extending generally from the root to the tip section of the elongated airfoil, positioned in the at least one trailing edge cooling channel between the second segmented spanwise rib and the trailing edge of the generally elongated airfoil, and including a plurality of impingement orifices.

8. The turbine airfoil of claim 7, further comprising at least one crossover orifices in the third segmented spanwise rib extending generally from an inner surface of a suction side of the airfoil to an inner surface of a pressure side of the airfoil.

9. The turbine airfoil of claim 7, wherein the at least one crossover orifice of the at least one first segmented spanwise rib is aligned spanwise with the at least one crossover orifice of the at least one second segmented spanwise rib, the plurality of impingement orifices in the at least one first segmented spanwise rib are offset spanwise with the plurality of impingement orifices in the at least one second segmented spanwise rib, and the plurality of impingement orifices in the at least one second segmented spanwise rib are offset spanwise with the plurality of impingement orifices in the at least one third segmented spanwise rib.

10. The turbine airfoil of claim 1, further comprising at least one third segmented spanwise rib extending generally from the root to the tip section of the elongated airfoil, positioned between the second segmented spanwise rib and the trailing edge of the generally elongated airfoil, and including a plurality of impingement orifices.

11. A turbine airfoil, comprising:

a generally elongated airfoil having a leading edge, a trailing edge, a tip section at a first end, a root coupled to the airfoil at an end generally opposite the first end for supporting the airfoil and for coupling the airfoil to a disc, and at least one cavity forming a cooling system in the airfoil;

at least one trailing edge cooling channel extending from the root to the tip section of the elongated airfoil;

at least one first segmented spanwise rib positioned in the at least one trailing edge cooling channel, extending generally from the root to the tip section of the elongated airfoil, and including a plurality of impingement orifices;

at least one second segmented spanwise rib, extending generally from the root to the tip section of the elongated airfoil, positioned in the at least one trailing edge cooling channel between the first segmented spanwise rib and the trailing edge of the generally elongated airfoil, and including a plurality of impingement orifices; and at least one third segmented spanwise rib extending generally from the root to the tip section of the elongated airfoil, positioned in the at least one trailing edge cooling channel between the second segmented spanwise rib and the trailing edge of the generally elongated airfoil, and including a plurality of impingement orifices;

at least one crossover orifice positioned between an end of the at least one first segmented spanwise rib and the tip section of the airfoil and between another end of the at least one first segmented spanwise rib and the root;

at least one crossover orifice positioned between an end of the at least one second segmented spanwise rib and the tip section of the airfoil and between another end of the at least one second segmented spanwise rib and the root;

at least one crossover orifice positioned between an end of the at least one third segmented spanwise rib and the tip section of the airfoil and between another end of the at least one third segmented spanwise rib and the root;

at least one crossover orifice in the at least one first segmented spanwise rib between the crossover orifices at each end at least one first segmented spanwise rib and extending generally from an inner surface of a suction side of the airfoil to an inner surface of a pressure side of the airfoil;

at least one crossover orifice in the at least one second segmented spanwise rib between the crossover orifices at each end of the at least one second segmented spanwise rib and extending generally from the inner surface of the suction side of the airfoil to the inner surface of the pressure side of the airfoil;

at least one crossover orifice in the at least one third segmented spanwise rib between the crossover orifices at each end of the at least one third segmented spanwise rib and extending generally from the inner surface of the suction side of the airfoil to the inner surface of the pressure side of the airfoil; and wherein the crossover orifices each have a larger cross-sectional area than cross-sectional areas of the impingement orifices.

12. The turbine airfoil of claim 11, wherein the at least one crossover orifice of the at least one first segmented spanwise rib is aligned spanwise with the at least one crossover orifice of the at least one second segmented spanwise rib and the at least one crossover orifice of the at least one second segmented spanwise rib is aligned spanwise with the at least one crossover orifice of the at least one third segmented spanwise rib.

13. The turbine airfoil of claim 12, wherein the plurality of impingement orifices in the at least one first segmented spanwise rib are offset spanwise with the plurality of impingement orifices in the at least one second segmented spanwise rib, and the plurality of impingement orifices in the at least one second segmented spanwise rib are offset spanwise with the plurality of impingement orifices in the at least one third segmented spanwise rib.

14. The turbine airfoil of claim 11, wherein the at least one crossover orifice of the at least one first segmented spanwise rib is offset spanwise from the at least one crossover orifice of the at least one second segmented spanwise rib, and the at least one crossover orifice of the at least one second segmented spanwise rib is offset spanwise from the at least one crossover orifice of the at least one third segmented spanwise rib.

15. The turbine airfoil of claim 14, wherein the plurality of impingement orifices in the at least one first segmented spanwise rib are offset spanwise from the plurality of impingement orifices in the at least one second segmented spanwise rib and the plurality of impingement orifices in the at least one second segmented spanwise rib are offset spanwise from the plurality of impingement orifices in the at least one third segmented spanwise rib.

16. The turbine airfoil of claim 11, wherein the plurality of impingement orifices in the at least one first segmented spanwise rib are offset spanwise from the plurality of impingement orifices in the at least one second segmented spanwise rib and the plurality of impingement orifices in the at least one second segmented spanwise rib are offset spanwise from the plurality of impingement orifices in the at least one third segmented spanwise rib.

* * * * *